United States Patent [19]

Modarelli, Jr.

[11] 3,975,878

[45] Aug. 24, 1976

[54] MODULAR BUILDING WITH INTERLOCKING PANELS

[76] Inventor: Donald W. Modarelli, Jr., 406 Ilse Drive, Newark, Del. 19711

[22] Filed: Jan. 15, 1975

[21] Appl. No.: 541,374

Related U.S. Application Data

[63] Continuation-in-part of Ser. No. 285,958, Sept. 5, 1972, abandoned.

[52] U.S. Cl. ..... 52/285; 52/79; 52/309; 52/393

[51] Int. Cl.[2] ..... E04G 1/02

[58] Field of Search ..... 52/285, 79, 309, 393, 52/585

[56] References Cited

UNITED STATES PATENTS

| | | | |
|---|---|---|---|
| 2,736,072 | 2/1956 | Woods | 52/81 |
| 2,737,309 | 3/1956 | Miller | 52/81 |
| 2,913,779 | 11/1959 | Hedgrew | 52/393 |
| 3,025,640 | 3/1962 | Muhr | 52/585 |

*Primary Examiner*—John E. Murtagh

*Attorney, Agent, or Firm*—Caesar, Rivise, Bernstein & Cohen, Ltd.

[57] ABSTRACT

A relocatable modular building, formed of a plurality of external wall portions. Each wall portion includes a plurality of small, integral molded plastic panels disposed adjacent to one another. The panels include interlocking means to facilitate the erection of the wall and to strengthen the erected wall. A plurality of bolts join immediately adjacent panels to one another to form the wall portions. Each wall portion includes weatherproof gasketing material interposed between the immediately adjacent panels. Windows and a door are provided in respective wall portions of the building.

5 Claims, 20 Drawing Figures

FIG. 1
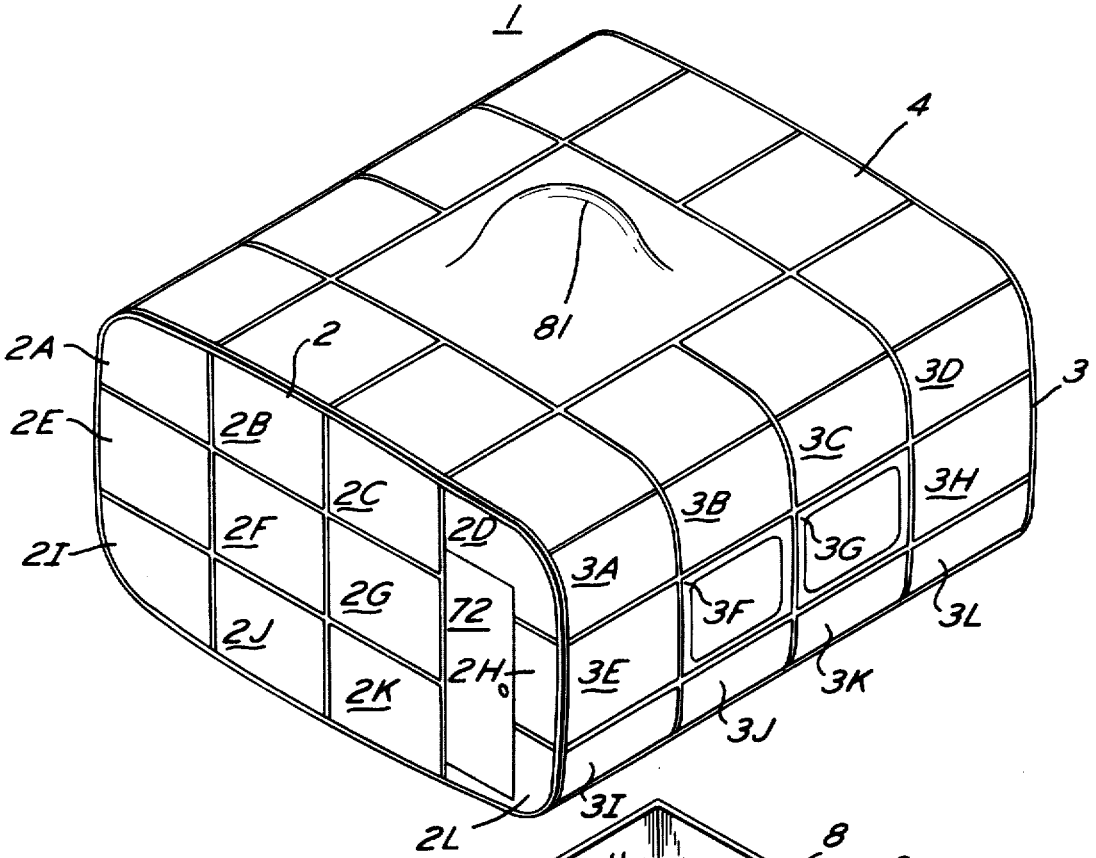
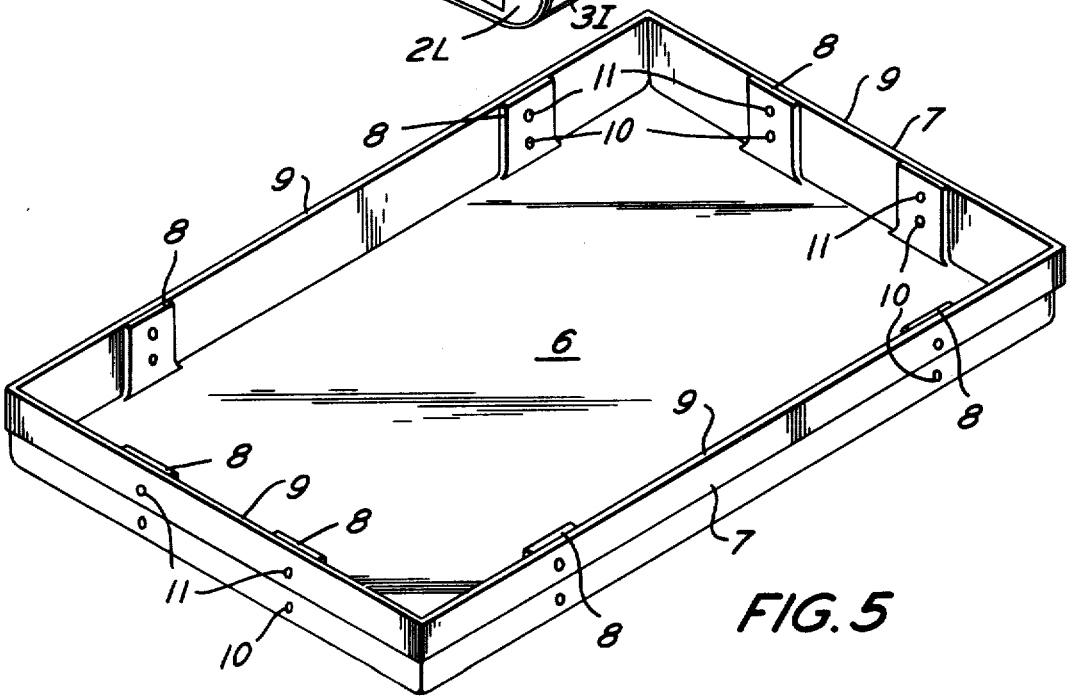
FIG. 5

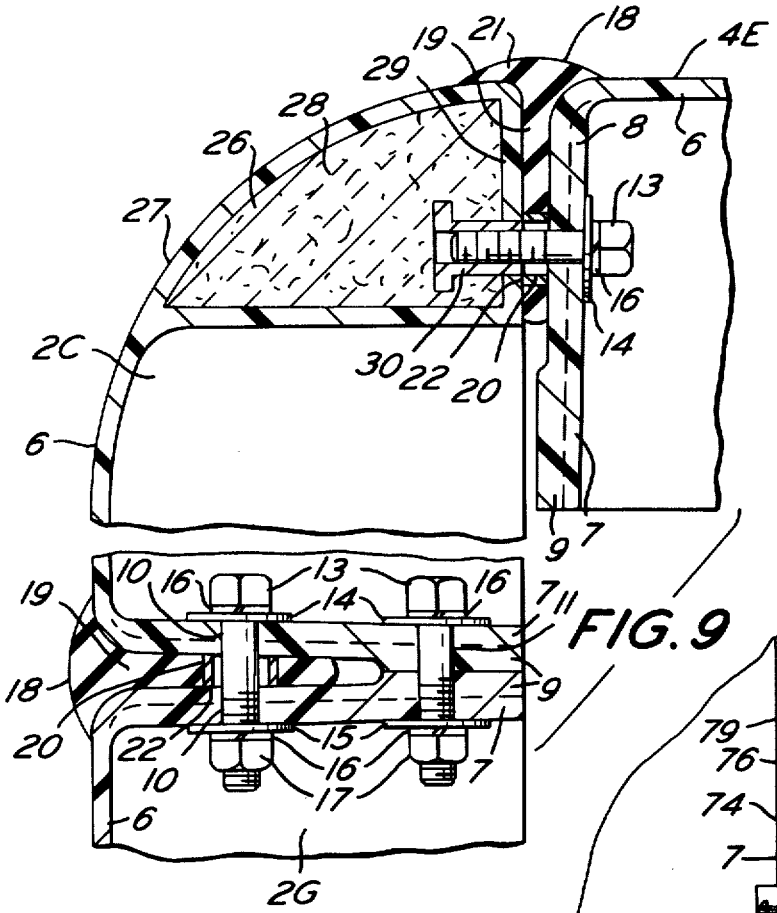
FIG. 9
FIG. 12
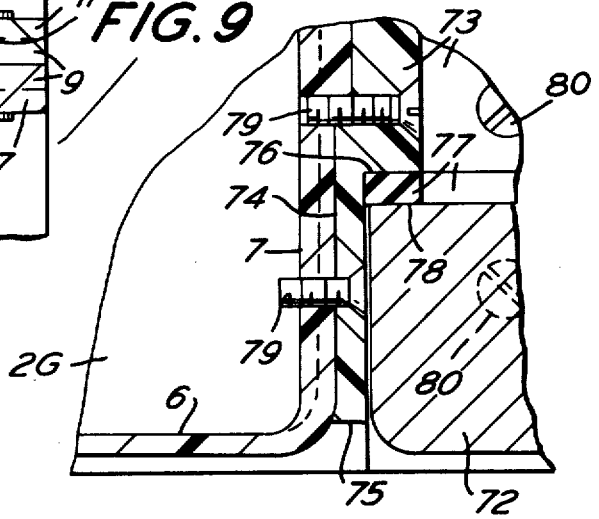
FIG. 11
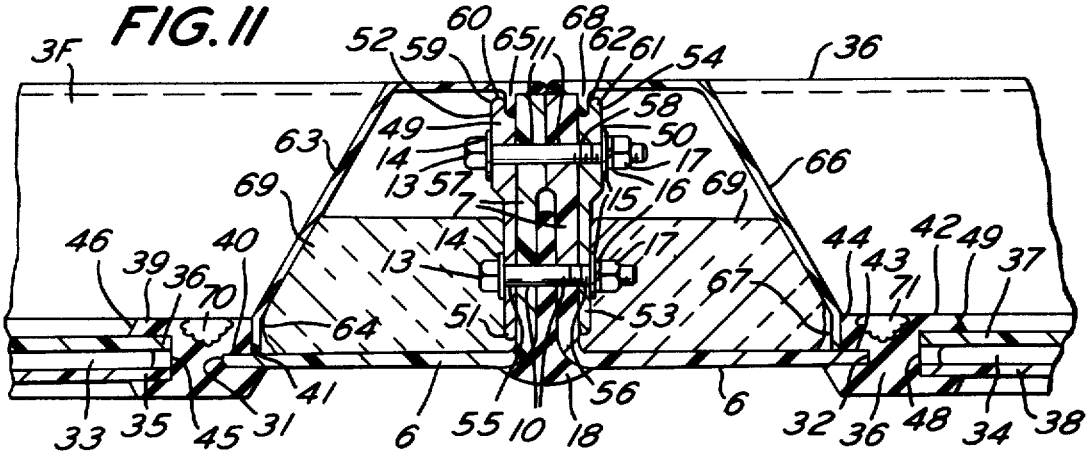

MODULAR BUILDING WITH INTERLOCKING PANELS

This application is a continuation-in-part of U.S. Pat. application Ser. No. 285,958, filed on Sept. 5, 1972, and now abandoned whose disclosure is incorporated by reference herein.

This invention relates generally to buildings and more particularly to prefabricated modular buildings.

With the ever increasing amount of leisure time available to the average person in industrialized societies, there is a growing demand for low cost, relocatable housing such as camping cabins, ski chalets, etc. To that end there are presently available various prefabricated modular housing units. Although more economical than custom or handmade structures, commercially available modular buidlings nevertheless leave much to be desired from the standpoint of cost, ease of assembly and disassembly as well as repairability. For example, buildings having walls which are each formed of a single integral fiberglass molded panel are relatively expensive to fabricate owing to the fact that forming of whole wall panels normally necessitates costly hand molding techniques in order to achieve critical dimensional tolerances. Furthermore, since whole wall panels tend to be relatively large and cumbersome they therefore increase handling as well as building assembly costs.

In the interest of keeping manufacturing costs low, prefabricated building manufacturers normally offer only a few building styles or models, i.e. a few combinations of a few different whole wall panels. Customization of a building for a particular appearance, use and/or weather conditions can increase manufacturing costs considerably even if the customization is only moderate by necessitating the use of special wall molds or manufacturing processes and techniques.

Apart from the disadvantages attendant in construction and assembly of prior art prefabricated whole wall panel buildings, such buildings may prove difficult as well as expensive to repair. For example, severe damage to a portion of a wall may necessitate the replacement of the entire wall.

It is a general object of this invention to provide a modular building which overcomes disadvantages of prior art prefabricated buildings.

It is a further object of this invention to provide a modular building having wall portions so constructed as to effectuate ease of assembly and disassembly.

It is a yet a further object of this invention to provide a prefabricated modular building having wall portions so constructed as to effectuate the repair thereof in the event that said portion sustains damage.

It is still a further object of this invention to provide a low cost modular building whose structure can be readily modified to a wide range of styles, uses and conditions.

These and other objects of this invention are achieved by providing a prefabricated modular building including a first external wall portion comprising at least two molded structural panels disposed adjacent to one another, each panel including a planar portion and a flanged portion upstanding generally normally therefrom, each flange including interlock means comprising a recess in the outside surface of said flange and a tab extending outward from said outside surface and spaced from said recess, the flange portion of one panel abutting a corresponding flange portion of the other panel with the tab of one flange being disposed within the recess of the abutting flange, said panels being secured to one another by at least one bolt extending through said flanges so that when said panels are secured to one another by said bolts said panels are self-supporting without the use of other structural support means.

Other objects and many of the attendant advantages of this invention will be readily appreciated as the same becomes better understood by reference to the following detailed description when considered in connection with the accompanying drawings wherein:

FIG. 1 is a perspective view of a modular building in accordance with this invention;

FIG. 5 is an enlarged perspective view of a typical modular panel used in the modular building shown in FIG. 1;

FIG. 9 is an enlarged fragmentary sectional view taken along line 9—9 of FIG. 2;

FIG. 11 is a partial cross-sectional view taken along line 11—11 of FIG. 3;

FIG. 12 is a cross-sectional view taken along line 12—12 of FIG. 2;

Figure 2:
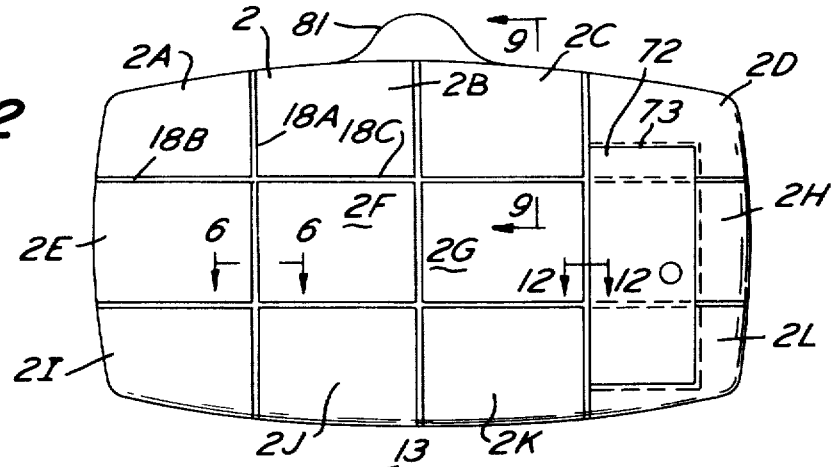
FIG. 2 is a front elevational view of the building shown in FIG. 1.

Referring now in greater detail to the various figures of the drawings wherein like reference characters refer to like parts of the modular housing or building embodying the present invention is generally shown at 1 in FIG. 1. While the building 1 is particularly suited for use as a relocatable recreational house (e.g. a camping cabin, beach house, ski chalet, etc.) it is to be understood that a modular building in accordance with this invention can be adapted for other than recreational uses, such as for example, portable hospital units, relocatable classroom units, construction site offices, drive-in bank booths, refreshment stands and temporary housings for disaster victims.

Modular housing 1 includes plural external wall portions, three of which can be seen in the perspective view of FIG. 1, namely, front-wall portion 2, side-wall portion 3, and top-wall portion 4. The back-wall portion of the housing 1 as well as the other side-wall portion thereof are not shown in any of the figures. The bottom-wall portion of the building cannot be seen in the perspective view of FIG. 1 but is shown in detail in the plan view of FIG. 4 and is denoted by the reference numeral 5.

Each wall portion comprises a plurality of relatively small and lightweight interconnected, modular panels. In accordance with the preferred embodiment of this invention the modular panels are made of fiberglass reinforced plastic and are formed within precision matched metal dies. By so doing, like panels can be kept within the precise dimensional tolerances requisite for free, panel interchangeability. The structural details of selected modular panels will be considered later.

As can be seen in the views of FIGS. 1 and 2, front-wall portion 2 includes integral modular panels 2A, 2B, 2C, 2D, 2E, 2F, 2G, 2H, 2I, 2J, 2K and 2L.

Figure 3:
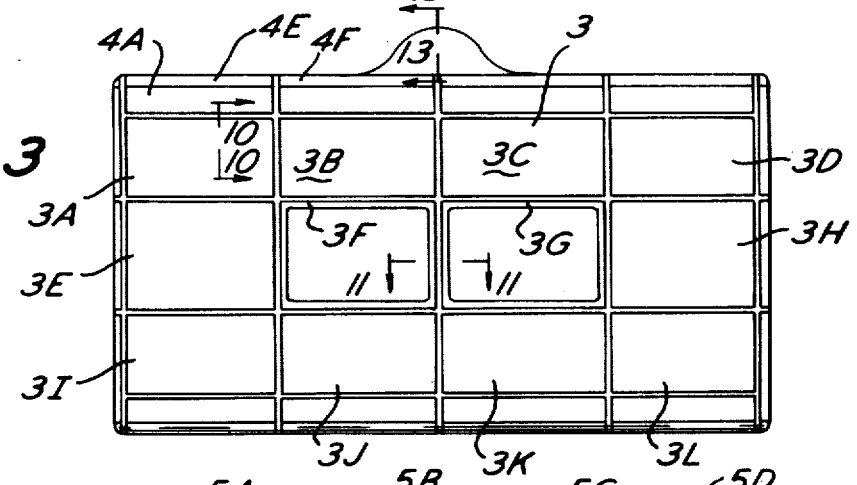
FIG. 3 is a side elevational view of the building shown in FIG. 1.

As can be seen in FIGS. 1 and 3 the right side-wall portion 3 of building 1 includes modular panels 3A, 3B, 3C, 3D, 3E, 3F, 3G, 3H, 3I, 3J, 3K and 3L.

Figure 4:
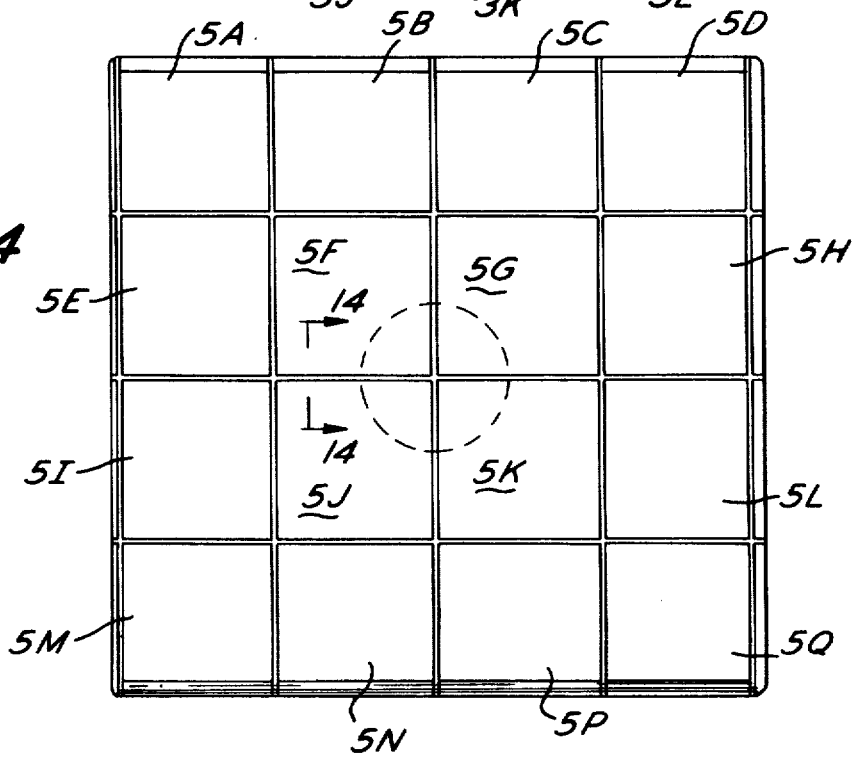
FIG. 4 is a bottom plan view of the building shown in FIG. 1.

As can be seen in the bottom plan view of FIG. 4 the bottom-wall portion 5 of building 1 includes modular panels 5A, 5B, 5C, 5D, 5E, 5F, 5G, 5H, 5I, 5J, 5K, 5L, 5M, 5N, 5P and 5Q.

The top-wall portion 4 of building 1 is shown in the perspective view of FIG. 1 and is constructed in a similar manner to that of bottom-wall 5 save for a feature to be discussed later.

The back-wall portion (not shown) of building 1 is constructed in a manner similar to front-wall portion 2 and the left side-wall portion (not shown) is constructed in a similar manner to right side-wall portion 3.

While all of the panels of each wall portion have the same basic attributes, their overall shapes may differ slightly. For example, in wall portion 2, panels 2F and 2G, which are in the interior panels thereof, are identical to one another but are slightly different in shape from the panels forming the corners of wall portion 2, namely, panels 2A, 2D, 2I and 2L and from the panels forming the sides of wall portion 2, namely, panels 2A, 2C, 2E, 2H, 2J and 2K.

Panels 2B and 2I are of identical shape as are panels 2C and 2K. Although panels 2A and 2L have different overall shapes they are formed by the same pair of matched dies. The entire molded panel therefrom is used as panel 2A whereas a portion of a panel 2A is cut away to form panel 2L. In a similar manner panels 2D and 2I are formed in another pair of matched dies with a portion of a panel so produced cut away to form panel 2D. Panels 2E and 2H are formed by yet another pair of matched dies with a portion of a panel so produced cut away to form panel 2H.

In the side-wall portion 3, panels 3A, 3B, 3C, 3D, 3I, 3J, 3K and 3L are of identical shape. The panels 3E, 3F, 3G and 3H are formed in the same pair of matched dies with a portion of a panel so produced cut away to form panels 3F and 3G.

In the bottom-wall portion 5, panels 5A, 5B, 5C, 5D, 5M, 5N, 5P and 5Q are of identical shape and panels 5E, 5F, 5G, 5H, 5I, 5J, 5K and 5L are of identical shape.

The panels 2A, 2B, 2C, 2D, 2E, 2F, 2G, 2H, 2I, 2J, 2K and 2L are disposed adjacent to one another with immediately adjacent panels securely connected to one another (by means to be described later) to form wall portion 2. To that end, panel 2A is connected to panels 2B and 2E. Panel 2B is also connected to panels 2C and 2F, whereas panel 2E is also connected to panel 2F and 2I. Panel 2F is in turn connected to panels 2J and 2G. Panel 2G is connected to panels 2C and 2K. Panel 2H is connected to panels 2D and 2L, panel 2D is connected to panel 2C and panel 2L is connected to panel 2K.

Like the panels in wall portion 2, the panels 3A, 3B, 3C, 3D, 3E, 3F, 3G, 3H, 3I, 3J, 3K and 3L are securely connected to one another to form wall portion 3. To that end panel 3A is connected to panel 3B and 3E, panel 3B is in turn connected to panel 3C and 3F, whereas panel 3E is is turn connected to panels 3F and 3I. Panel 3F is in turn connected to panels 3G and 3J. Panel 3G is connected to panels 3C, 3H and 3K, panel 3H is in turn connected to panels 3D and 3L, panel 3D is connected to panel 3C and panel 3L is connected to panel 3K.

The panels forming the bottom-wall portion 5 of building 1 are disposed adjacent to one another and are interconnected in the following manner; panel 5A is connected to panels 5B and 5E, panel 5B is in turn connected to panels 5C and 5F, whereas panel 5E is connected to panel 5F and 5I. Panel 5F is also connected to panels 5G and 5J. Panel 5G is in turn connected to panels 5C, 5H and 5K. Panel 5J is connected to panels 5K, 5N and 5I. Panel 5I is connected to panel 5M which is in turn connected to panel 5N. Panel 5N is connected to panel 5P which is in turn connected to panel 5K. Panel 5C is connected to panels 5B, 5D and 5G. Panel 5D is in turn connected to panel 5H. Panel 5H is connected to panel 5G and panel 5L. Panel 5L is connected in turn to panels 5K and panel 5Q. Panel 5Q is in turn connected to panel 5P.

Gasketing means, which will be described in detail later, is provided between immediately adjacent panels in order to ensure that each wall portion is completely weatherproof.

In FIG. 5 there is shown a perspective view of a panel, 2F, which is utilized in wall portion 2 of building 1. Panel 2F is typical of many of the panels used to form each of the wall portions of the building, that is, it includes a generally planar portion 6 and upstanding flange portions 7 which are provided along the periphery of planar portion 6.

It should be pointed out at this point that the planar portions of some modular panels may be slightly bowed yet still be within the meaning of the phrase "generally planar portion" as used within this specification.

Each flange portion 7 includes on one side thereof two increased thickness portions or mesa's 8 and on the other side thereof an increased thickness portion of lip 9 running along the peripheral edge thereof. A pair of holes 10 and 11 are provided through each mesa portion 8, hole 10, passing through only mesa portion 8 of flange 7 and hole 11 passing through the flange lip portion 9 as well as mesa portion 8. The planar portion 6, flange portion 7, mesa portions 8 and lip portions 9 of each modular panel are formed as an integral structural unit in matched metal dies as previously noted.

The holes which are provided in the flanged portions of the modular panels, in conjunction with fastening means to be described later, serve to effectuate the rapid and secure connection of the panels to one another.

Figure 6:
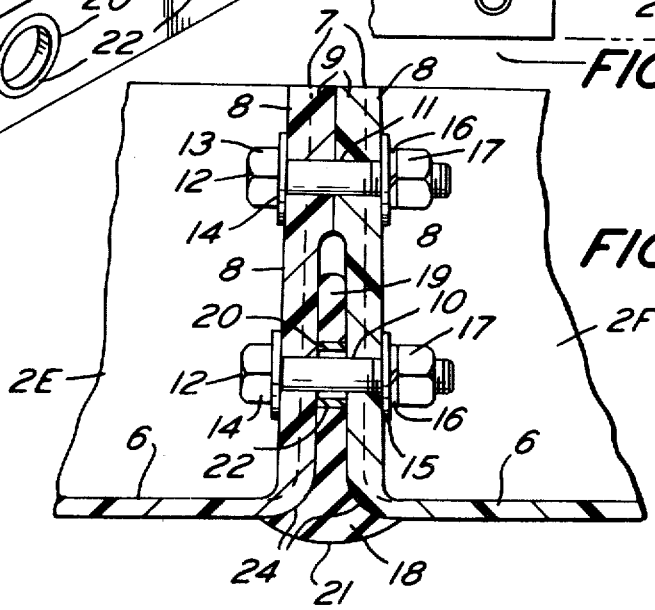
FIG. 6 is an enlarged fragmentary cross-sectional view taken along lines 6—6 of FIG. 2.

A typical connection between immediately adjacent panels is shown in the partial cross-sectional view of FIG. 6. As can be seen therein the rib portion 9 on flange 7 of panel 2E abuts the rib portion of the flange of panel 2F such that the respective holes 11 thereof are axially aligned. The holes 10 in the panels are also axially aligned.

A pair of readily-disconnectable, fixed fastening means is provided to join panel 2E to panel 2F via their respective flange portions 7. Such fastening means is typical of the fastening means used throughout the building to connect immediately adjacent panels to one another. In accordance with the preferred embodiment of this invention the readily disconnectable fixed fastening means 12 is formed of weatherproof material (e.g. brass) and comprises an elongated threaded tie bolt 13, a pair of flat washers 14 and 15, a lock washer 16 and a nut 17.

As can be seen in FIG. 6 the shaft portion of tie bolt 13 passes through axially aligned holes 11 with the head of the bolt adjacent to the flange 7 of panel 2E. A flat washer 14 is disposed between the head of bolt 13 and the inside surface of the flange portion of panel 2E. A flat washer 15 is provided about the threaded shaft of tie bolt 13 and is disposed on the inside surface of the flange portion of panel 2F. A nut 17 is screwed on to the threaded portion of tie bolt 13. A lock washer 16 is interposed between the nut 17 and the flat washer 15. Another elongated threaded tie bolt 12 is provided in axially aligned holes 10 in both panels and is arranged in an identical manner to the tie bolt associated with holes 11.

When the tie bolt 13 in the axially aligned holes 11 is tightened, the outer surfaces of the rib portion of flanges 8 abut one another whereas the non-ribbed portions of said flanges are spaced apart from one another. A gasket strip 18 is provided within the space between the non-ribbed portions of the adjacent flanges to provide a weatherproof seal between the panels. The gasket strip includes a flat web portion 19 having a plurality of holes, 20, therein and a rounded head portion 21. A metal ring 22 is provided within each gasket hole. The thickness of the ring is less than the thickness of the webbed portion for a reason to be considered later.

As can be seen, the web 19 of gasket 18 is interposed between the flanges of adjacent panels 2E and 2F with a metal ring lined hole 20 axially aligned with the holes 10 in said panels. The head 21 of the gasket strip is rounded 1/10 slightly overlap the relatively planar portions of the panels and includes on its underside two fillet portions 24 which mate with the curved portions of the panels between the flange 7 and the generally planar portion 6. As should be appreciated when the tie bolt 13 in hole 10 is tightened the web of gasket strip 18 is slightly compressed between the adjacent flanges 7 thereby sealing the joint between panels 2E and 2F. The thickness of ring 22 is slightly smaller than the thickness of the web so as not to impede the compression of the web portion of gasket 18.

Gasket strips are provided between all of the immediately adjacent panels of each wall of the housing to ensure that the housing is completely weatherproof.

In the preferred embodiment of this invention the respective front, back and side-wall portions of building 1 each include a unitary gasket strip provided between each column of vertically aligned panels. Separate gasket strips are provided between the immediately adjacent vertically aligned panels of each column. For example, in the front side-wall panel 2 shown in FIG. 2 a first unitary gasket strip is provided between the respective immediately adjacent panels 2A and 2B, 2E and 2F, and 2I and 2J, a second unitary gasket strip is provided between the respective immediately adjacent panels 2B and 2C, 2F and 2G, and 2J and 2K, and a third unitary gasket strip is provided between the respective immediately adjacent panels 2C and 2D, and 2K and 2L. Separate gasket strips are provided between the immediately adjacent vertically aligned panels 2A and 2E and between immediately adjacent vertically aligned panels 2E and 2I. Separate gasket strips are also provided between the immediately adjacent vertically aligned panels 2B and 2F, between immediately adjacent vertically aligned panels 2F and 2J, between the immediately adjacent vertically aligned panels 2C and 2G, between immediately adjacent vertically aligned panels 2G and 2K, between the immediately adjacent vertically aligned panels 2D and 2H and between immediately adjacent vertically aligned panels 2H and 2L.

In the top and bottom-wall portions of building 1 single gasket strips are provided along each row of the longitudinally aligned panels, whereas separate gasket strips are provided between the immediately adjacent longitudinally aligned panels of each row. For example, in the bottom side-wall portion shown in FIG. 4, a first unitary gasket strip is provided between respective immediately adjacent panels 5A and 5E, 5B and 5F, 5C and 5G, and 5D and 5H. A second unitary gasket strip is provided between respective immediately adjacent panels 5E and 5I, 5F and 5J, 5G and 5K, and 5H and 5L. A third unitary gasket strip is provided between respective immediately adjacent panels 5I and 5M, 5J and 5N, 5K and 5P, and 5L and 5Q. Separate gasket strips are provided between the respective immediately adjacent longitudinally aligned panels 5A and 5B, 5B and 5C, and 5C and 5D. Separate gasket strips are provided between the respective immediately adjacent longitudinally aligned panels 5A and 5B, 5B and 5C, and 5C and 5D. Separate gasket strips are provided between respective longitudinally aligned panels 5E and 5F, 5F and 5G, and 5G and 5H. Separate gasket strips are provided between the respective immediately adjacent longitudinally aligned panels 5I and 5J, 5J and 5K, and 5K and 5L. Separate gasket strips are provided between the respective immediately adjacent longitudinally aligned panels 5M and 5N, 5N and 5P, and 5P and 5Q.

Figure 7:
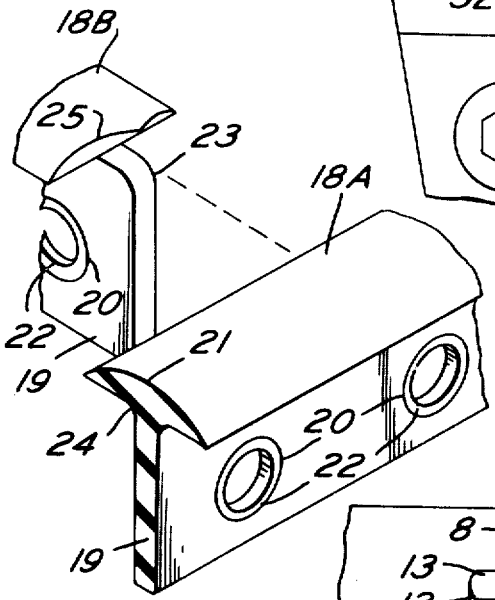
FIG. 7 is an exploded perspective view of a portion of a typical gasket joint.
Figure 8:
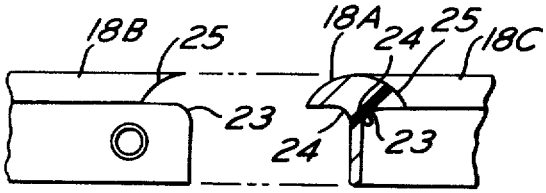
FIG. 8 is an elevational view, partially exploded, of a typical gasket joint.

FIG. 7 is an exploded perspective view of a portion of a typical joint between different gasket strips and FIG. 8 is an elevational view, partially exploded, of a joint between gasket strips.

The joints shown in FIG. 8 are typical of the many joints between the long gasket strips which are disposed between plural pairs of immediately adjacent panels and the shorter gasket strips which are disposed between only one pair of immediately adjacent panels, such as the joint formed by the intersection of the long gasket strip disposed between all of the respective adjacent panels 2A and 2B, 2E and 2F, and 2I and 2J, the shorter gasket strip disposed between immediately adjacent panels 2A and 2E and the shorter gasket strip disposed between the immediately adjacent panels 2B and 2F. Reference numeral 18A denotes the long gasket strip between panels 2A, 2B, 2E, 2F, 2I and 2J, reference numeral 18B denotes the gasket strip disposed between panels 2A and 2E and reference numeral 18C denotes the gasket strip disposed between panels 2B and 2F.

As can be seen in FIG. 7 the end of the web portion 19 of strip 18B includes a rounded portion 23 which has the same radius of curvature as the fillet 24 which is formed on the underside of the head of gasket strip 18A. The end of the head portion or gasket strip 18B is cut back from the web portion thereof along a curved line 25, which has the same radius of curvature as the radius of curvature of the head portion of gasket 18A. Accordingly, the end of the head portion of strip 18B mates to the head portion of strip 18A and the end of the webbed portion of strip 18B mates to the web of portion of strip 18A. In a similar manner the end of head portion 18C is cut back along a curved line 25 having the same radius of curvature as the head portion of strip 18A and the web portion of strip 18C has a rounded portion having the same radius of curvature as the fillet on the underside of the head strip 18A. The mating of strips 18A and 18C is shown clearly in FIG. 8.

FIG. 9 shows the connection between front-wall panel 2C and the immediately adjacent top-wall panel 4E and is typical of all front-wall-to-top-wall, front-wall-to-bottom-wall, back-wall-to-top-wall and back-wall-to-bottom-wall connections. As can be seen therein modular panel 2C includes generally planar portion 6 and flange 7. The latter of which is connected to flange 7 of immediately adjacent panel 2G in the same manner as heretofore discussed with reference to the connection between panels 2F and 2G shown in FIG. 6. The upper side of panel 2C includes an upstanding enlarged portion 26 which serves the same function as flange portion 7, i.e. effectuates connection between panels, and in addition provides a smooth transition between the planar portions 6 of panels 2C and 4E. To that end, portion 26 includes a surface 27 which curves from the plane of the planar portion 6 of panel 2C to the plane of the planar portion 6 of panel 4E.

A block of balsa wood 28 is embedded in the enlarged portion 26 to serve as an inexpensive space filler. The enlarged portion 26 includes a flat portion 29 which is parallel to planar portion 6 and which includes a threaded sleeve 30 therein. A gasket strip 18 is interposed between the non-ribbed portion of flange 8 and the flat portion 29 of panel 2C. The threaded sleeve 30 is provided to receive the threaded shaft of a tie bolt 13 which serves to connect the flange portion 7 of top-wall panel 4E to the flat portion 29 of front-wall panel 2C. To that end the head of tie bolt 13 is disposed adjacent to the flange of panel 4E with a flat washer 14 and a lock washer 16 interposed between the head of tie bolt 13 and the inside surface of the flange 7. The shaft of tie bolt 13 passes through the metal ring lined hole 20 in gasket strip 18 and is screwed into the threaded sleeve 30. Upon the tightening of tie bolt 13 the front-wall panel 2C is securely joined to the top-wall panel 4E.

Figure 10:
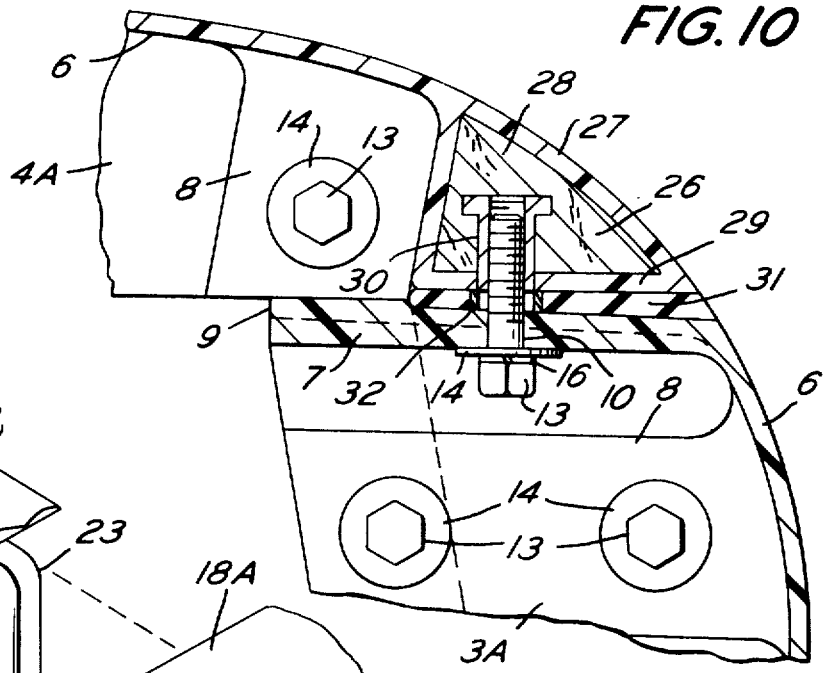
FIG. 10 is a partial cross-sectional view taken along line 10—10 of FIG. 3.

FIG. 10 shows the connection between a side-wall panel 3A and the immediately adjacent top-wall panel 4A and is typical of all side-wall-to-top-wall and side-wall-to-bottom-wall connections. As can be seen, top-wall panel 4A is similar to the previously described panel 2C in that it includes an enlarged upstanding portion 26 to provide a smooth transition between its generally planar portion 6 and the generally planar portion 6 of side-wall panel 3A and to effectuate the connection of said panels to one another. The enlarged portion 26 includes threaded sleeve 30 into which a tie bolt 13 is threaded. The tie bolt's shaft passes through a hole 10 in the flanged portion of panel 3A with its threaded ends screwed into the threaded sleeve 30 and its head disposed adjacent flange 7 of panel 3A. A flat washer 14 and a lock washer 16 are interposed between the head of tie bolt 13 and the inside surface of flange 7. Upon the tightening of tie bolt 13 side-wall panel 3A is securely joined to top-wall panel 4E.

As can be seen in FIG. 2 each of the side-wall panels 3F and 3G includes an aperture therein in which a transparent window is disposed. The apertures are formed by cutting out the mid-portion of the generally planar portions 6 of each panel after the panels have been molded.

FIG. 11 shows a connection between the two immediately adjacent side-wall panels 3F and 3G. As can be seen therein panel 3F includes aperture 31 and panel 3G includes aperture 32. A transparent window 33, having a pair of parallely spaced panes 35 and 36 is disposed within aperture 1 and a similar window 34 including parallely spaced panes 37 and 38 is disposed within aperture 32. Gasket window seals are provided in the respective apertures to mount the windows therein. To that end a gasket window seal 39 is mounted in aperture 31. The window seal includes a groove 40 extending along the outside periphery 41 of the seal. The edge portion of generally planar portion 6 which is formed by the aperture 31 is disposed within groove 40. A similar window seal 42 is mounted in aperture 32 of panel 3G via groove 43 in its outside periphery 44. Window seal 39 includes a second groove 45 extending along the inside periphery 46 of the seal and window seal 42 includes a second groove 48 extending along the inside periphery 49 of the seal. The window 33 is mounted within groove 45 of the seal 39 and the window 38 is mounted within groove 48 of the seal 42.

Panels 3F and 3G are connected to one another via tie bolts 13 through their respective flange portions 7 in the same manner as the connection between panels 2E and 2F. However, as can be seen in FIG. 11 a forked member 49 is interposed between the flat washers 14 at the heads of tie bolts 13 and the inside surface of the flange 7 of panel 3F. A similar forked member 50 is interposed between the flat washer 15 adjacent to nut 17 and the inside surface of the flange 7 of panel 3G. Forked member 49 includes a thin flat portion 51 and a thicker flat portion 52. Forked member 50 includes a thin flat portion 53 and a thicker flat portion 54. The thin flat portions of members 49 and 50 include holes 55 and 56, respectively, which are axially aligned with the holes 10 in the panels' flanges and through which tie bolt 13 passes. The thick flat portions of the member 49 and 50 include holes 57 and 58, respectively, which are axially aligned with the holes 11 in the panels' flanges and through which the other tie bolt 13 passes. The thick portion 52 of member 49 includes an edge 59 having a groove 60 therein. In a similar manner the thick portion 54 of member 50 includes an edge 61 having a groove 62 therein. A molded cover 63 is snap-fit between the peripheral surface 41 of seal 39 and the flange 7 of panel 3F. To that end cover 63 includes at one end a flat portion 64 abutting the peripheral edge 41 of seal 39 and includes at the other end an upstanding tab 65 which is snap-fit into the groove 60 of fork member 49. In a similar manner a cover 66 including at one end a flat portion 67 and at the other end thereof an upstanding tab 68 is snap-fit between the peripheral surface 44 of seal 49 and the flange 7 of panel 3G. Thermal insulation 69 is disposed within the space formed between cover 63, generally planar portion 6 and flange 7 of panel 3F and similar insulation 69 is disposed within the space formed by cover 66, generally planar portion 6 and flange 7 of panel 3G.

As can be seen there a hole 70 is disposed in a surface of window seal 39 between groove 45 and peripheral edge 41. A hard plug is inserted into hole 70 to urge the window seal 39 into intimate contact with window 33, the planar portion 6 of panel 3F and the flat portion 64 of cover 63. In a similar manner there is provided a hole 71 in window seal 42. A plug is inserted into hole 71 to force the window seal 42 into intimate contact with window 34, planar portion 6 of panel 3G and cover 66.

As can be seen in FIG. 2 the front-wall portion 2 of building 1 includes a door 72 which is mounted within a frame 73. Frame 73 is a unitary fiberglass frame and serves as the head, sill and jamb for door 72.

The frame is disposed within a hole in the wall portion 2 which is formed by cutting away portions of panels 2D, 2H and 2L (as will be described later).

FIG. 12 shows the manner with which frame 73 is connected to a typical wall panel. The outside surface of frame 73 is denoted as 74 and is configured to mate with the outside surface of the flange portion 7 of the panels to which it is connected. To that end, surface 74 of frame 73 mates with the outside surface of flange 7 of panel 2G. The frame 73 includes a front surface 75 which has a recessed portion 76 therein in which a band of weatherstripping material 77 is provided. The weatherstripping band 77 seals the space between the inside peripheral edge 78 of the door 72 and the bottom of the recessed portion 76 of frame 73. The side portion of the frame 73 is connected to the flange 7 of panel 2G via a pair of self-tapping screws 79 and the bottom portion of the frame is connected to a flange 7 in panel 2L via a pair of self-tapping screws 80.

As can be seen in FIG. 1 the top-wall portion of building 1 includes a dome or cupola 81. Cupola 81 is connected to top-wall panels 4F, 4G, 4J and 4K and is provided as a housing for ventilating or air conditioning means.

Figure 13:
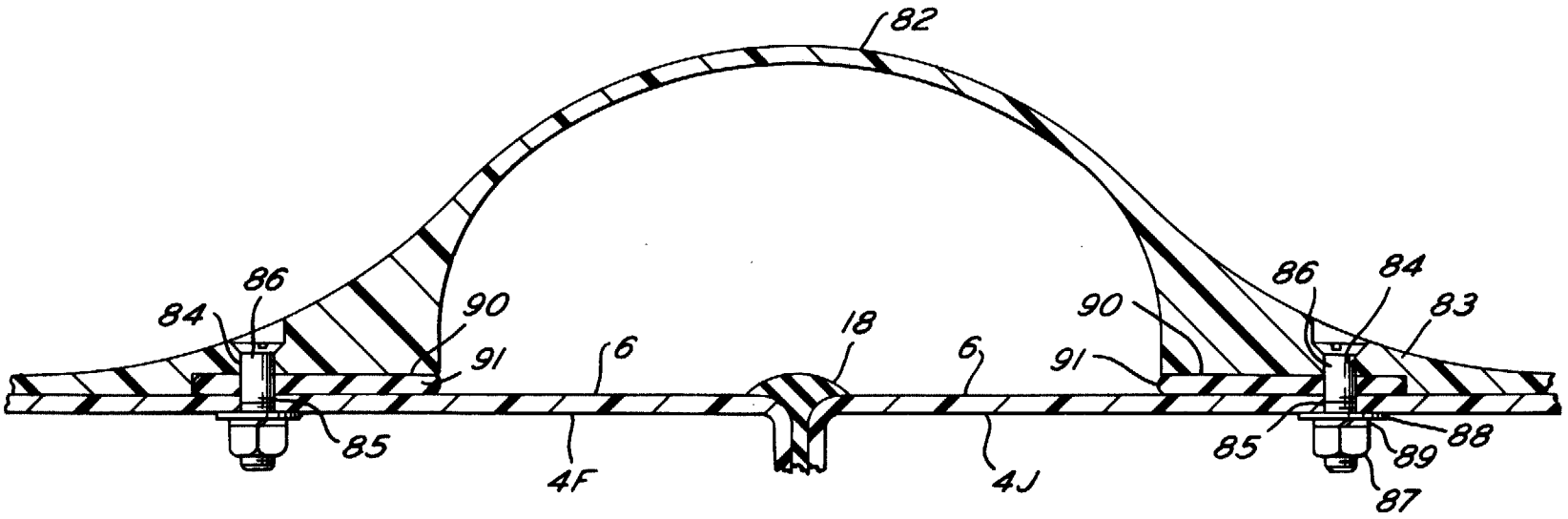
FIG. 13 is a cross-sectional view taken along line 13—13 of FIG. 3.

The mode of connection of cupola 81 to top-wall panels 4F and 4J is shown in the partial cross-sectional view of FIG. 13. Cupola 81, like the modular panels forming the walls is formed of a fiberglass reinforced plastic and includes a generally hemispheric portion 82 and a curved flanged portion 83. As can be seen a pair of holes 84 are provided through the curved flange 83 of the cupola 81. A hole 85 is provided in the planar portion 6 of top-wall panel 4F and a similar hole 85 is provided in the planar portion 6 of top-wall panel 4J. Each of the holes 85 is axially aligned with a respective hole 84 in the curved flanged portion of cupola 81. Bolts 86 are provided to connect cupola 81 to the top-wall portion of building 1. To that end a bolt 86 is provided in the aligned holes 84 and 85 of panel 4F and another bolt 86 is provided in the aligned holes 84 and 85 of panel 4J. A threaded nut 87 is screwed onto the threaded end of bolt 87 adjacent to planar portion 6 of panel 4F with a flat washer 88 and the lock washer 89 interposed between the nut 87 and the inner surface of said planar portion. A second threaded nut 87 is screwed onto the threaded end of bolt 86 adjacent to planar portion 6 of panel 4J with a flat washer 88 and a lock washer 89 interposed between the nut 87 and the inner surface of said planar portion. The underside of curved flange 83 includes a recess 90 in which a gasket seal 91 is disposed.

The modular building 1 includes interior walls, ceilings and floors. Suitable thermal insulation may be provided in the spaces between the modular panels and the interior walls, ceilings and floors.

Figure 14:
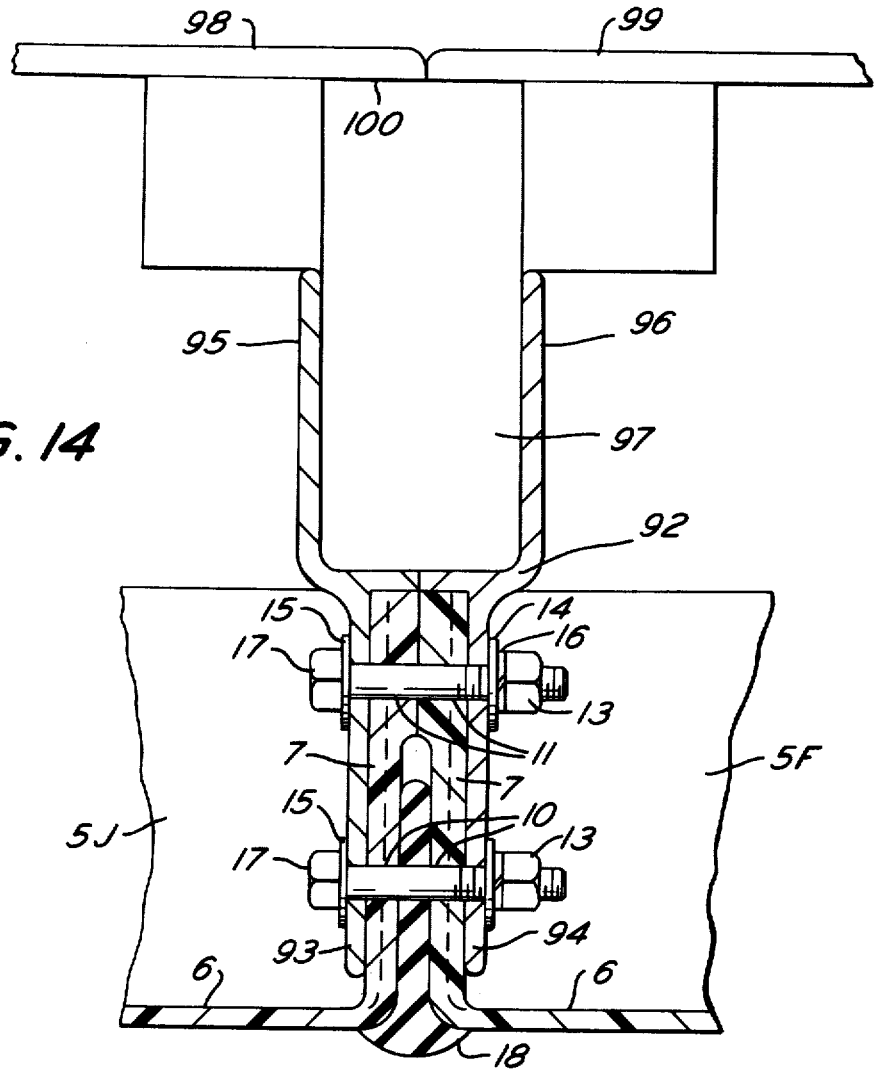
FIG. 14 is a cross-sectional view taken along line 14—14 of FIG. 4.

In the partial cross-sectional view of FIG. 14 there is shown in conjunction with the typical joint between immediately adjacent panels, means for supporting thereon the interior floor of the building 1. The interior walls and ceiling of the building 1 may be mounted to the modular wall panels in a manner similar to the manner utilized to mount the interior floor.

As can be seen in FIG. 14 panels 5F and 5J are connected to one another via their respective flanges 7, tie bolts 13, flat washers 14 and 15, lock washers 16 and nuts 17. A yoke member 92 is mounted on the abutting flanges 7 and serves as the support for the interior floor of building 1. To that end yoke member 92 includes a pair of spaced legs 93 and 94. Leg 93 includes a pair of holes through which bolts 13 pass and is interposed between flat washers 15 on said bolts and the inside surface of the flange 7 of panel 5J. Leg 94 includes a pair of holes through which said tie bolts pass and is interposed between the flat washers 14 and the inside surface of the flange 7 of panel 5F. When tie bolts 13 are tightened yoke member 92 is rigidly mounted on the abutting flanges of panels 5J and 5F. Yoke member 92 includes a pair of upstanding legs 95 and 96 which form a yoke. The yoke is adapted for supporting therein a wood stud 97. Stud 97 serves as the base for the interior floor panels. To that end a pair of interior floor panels 98 and 99 are mounted on the top portion 100 of stud 97. A pair of wood spacers 101 are connected to stud 97 and serve to provide additional support for floor panels 98 and 99.

A building constructed in accordance with this invention can be made available in a large number of styles and modifications, e.g. the number and position of doors and/or windows in wall portions can be changed from building to building, without necessitating custom made dies and/or expensive manufacturing techniques. To that end certain modular panels of this invention include additional flange portions which are utilized in modifying said panels for different uses. For example, a pair of matched dies, shaped to produce panel 2A is also used to provide a panel for use as panel 2E. In accordance with that aspect of the invention, a portion of the panel formed in the dies which produce panels 2A is cut away along the additional flanges to form panel 2L.

Figure 15:
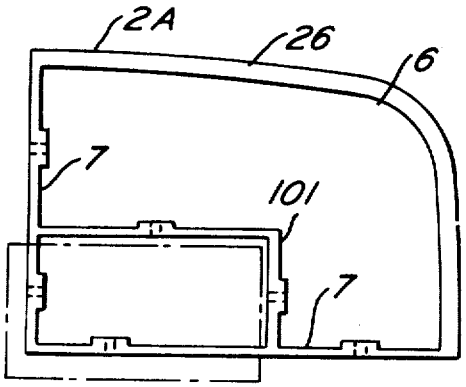
FIG. 15 is an elevational view of a modular panel used in the modular building shown in FIG. 1.

In FIG. 15 there is shown an elevational view of panel 2A. As can be seen therein panel 2A includes upstanding flange portions 7 of type previously discussed which are disposed along two sides of generally planar portion 6. Enlarged upstanding portions 26, of the type previously discussed, are provided along the remaining sides of the planar portion 6. Additional upstanding flange portions 102 are provided on the interior of planar portion 6. The additional flanges are similar in construction to flanges 7 (i.e. include mesa and ribbed portions, etc.). Panel 2A can be readily converted to panel 2L by removing (e.g. cutting away) a portion of the panel 2A outside of the additional flanges 102 (i.e. the portion shown within the schematically broken lines).

Panel 2I, includes additional flange portions 102 arranged like those in panel 2A. Panel 2I can be readily converted to panel 2D by removing a portion of panel 2I outside its additional flanged portions.

Figure 16:
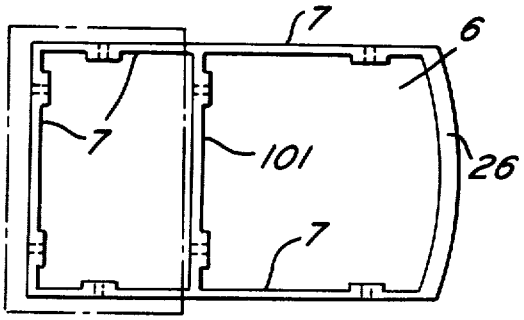
FIG. 16 is an elevational view of another modular panel used in the modular building shown in FIG. 1.

In FIG. 16 there is shown an elevational view of panel 2E. As can be seen therein panel 2E includes flange portions 7, of the type previously discussed, along three sides of generally planar portion 6. An enlarged upstanding portion 26, of the type previously discussed, is provided along the remaining side of planar portion 6. An additional upstanding flange portion 102 is provided on the interior of planar portion 6. The additional flange 102 is similar in construction to flange 7.

Panel 2E may be readily converted to panel 2H by removing (e.g. cutting away) the portion of the panel 2E outside of the additional flange portion 102 (i.e. the portion shown within the schematically broken line).

As a result of the modifiability of selected wall panels as discussed above, building 1 can be readily modified such that it front and back-wall portions include either a door on the right, a door on the left, a door on the right and left or no door at all. For example, door 72 can be disposed within an opening formed in panels 2A, 2E and 2I in lieu of that which is shown in FIGS. 1 and 2, by merely removing portions of said panels as discussed above with reference to the formation of panels 2L, 2H and 2D, respectively, and mounting the door frame 73 to the additional flange portions 102 of the panels so produced. In addition the side-wall portions of building 1 can be made to include as many or as few windows as desired by merely removing the central portion of selected side-wall panels and inserting the windows therein.

Figure 17:
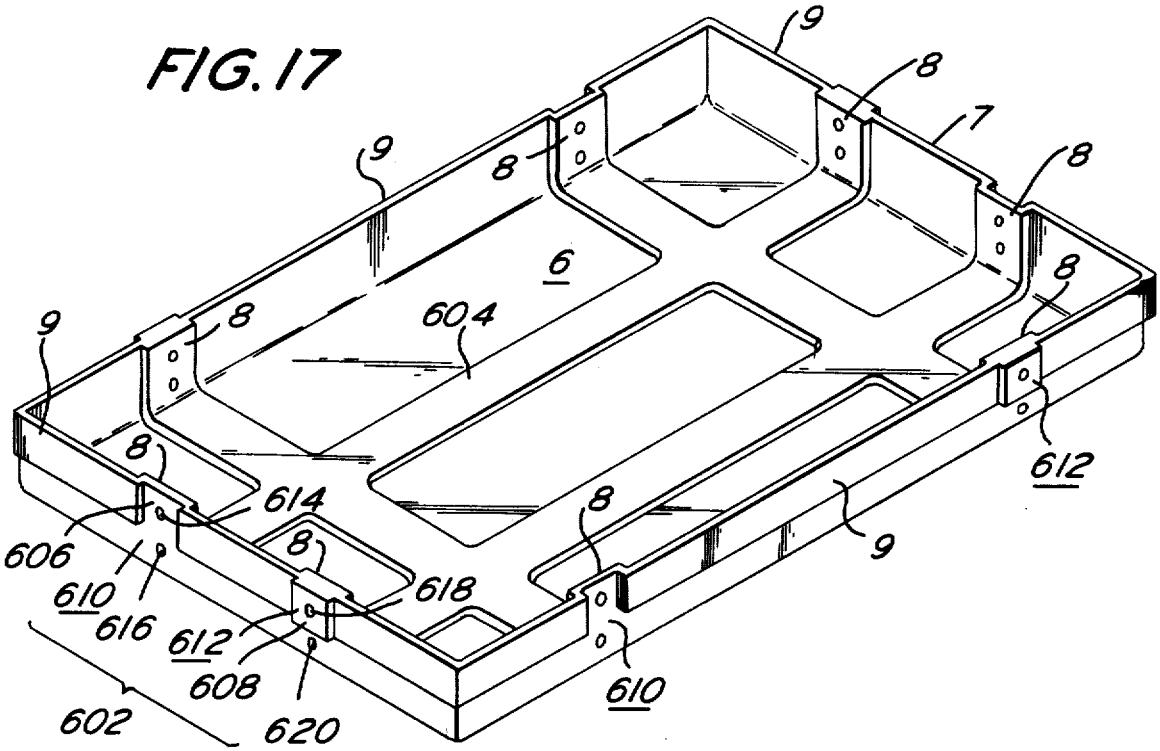
FIG. 17 is an enlarged perspective view of a typical modular panel used in the modular building shown in FIG. 1.

In FIG. 17 there is shown a perspective view of panel 600, which is preferably utilized in wall portions 2, 3 and 4 of building 1 in lieu of the various panels shown in FIG. 1 in order to provide a more rugged and stable modular building 1 and which is capable of quick and easy erection without the need for skilled workmen or special tools or techniques.

As can be seen in FIG. 17 the panel 600 is similar in many respects to panel 2F shown in FIG. 5 but includes interlocking means 602 not included in panel 2F and which provide the panel 600 with significant structural advantages over panel 2F. For example, the presence of the interlocking means 602 on the panels 600 facilitates the erection of a wall formed of such panels by enabling adjacent panels to be positively aligned with respect to each other in a simple and expeditious manner during the erection process.

In addition to facilitating the erection of a multi-paneled wall, the interlocking means 602 of the panels 600 coact with one another to produce a wall which is more resistent to shear than a corresponding wall formed of panels constructed like that of panel 2F. Further still, the coaction of the interlocking means of the adjacent panels effects the transfer of stress from one panel to the next panel to equalize the stress throughout the wall and thereby decrease the chance of structural failure.

As can be seen in FIG. 17 panel 600 is typical of the many panels used to form each of the wall portions of the building, that is, it includes generally planar portion 6 and upstanding flange portion 7 which are provided along periphery of planar portion 6.

It should be pointed out at this juncture that the planar portions of some of the modular panels may be slightly bowed yet still be within the meaning of the phrase "generally planar portion" as used within this specification.

Each flange portion 7 includes on the inside thereof two raised portions or mesa's and on the outside thereof an increased thickness portion or lip 9 running along the peripheral edge thereof. The inside surface of planar portion 6 of panel 200 includes increased thickness portions or ribs 604 extending between opposed mesa's 8. The ribs 604 serve as stiffening members for the wall panel 600.

As can be seen in FIG. 17 the outside surface of the lip portion 9 contiguous with one mesa 8 includes a rectangular recess 606 therein. The recess extends the full width of the lip 9 in one direction and extends for a substantial portion of the width of mesa 8 in the other direction (see the enlarged view in FIG. 19). The depth of the recess 606 is dimensioned so that the bottom surface of the recess is flush with the outside surface of flange 7.

A thickened portion or tab 608 is provided on lip 9 opposite the other mesa 8 of the flange 7. The tab 608 is arranged for insertion within a recess 606 in an adjacent panel to effect the interlocking of the two panels to one another. To that end, the height panel 608 is dimensioned to the same or slightly less than the depth of recess 606 while the area of the tab is the same or slightly smaller than the area of said recess.

As should be appreciated, the recess 606 and the tab 608 form the heretofore described interlocking means 602.

Figure 18:
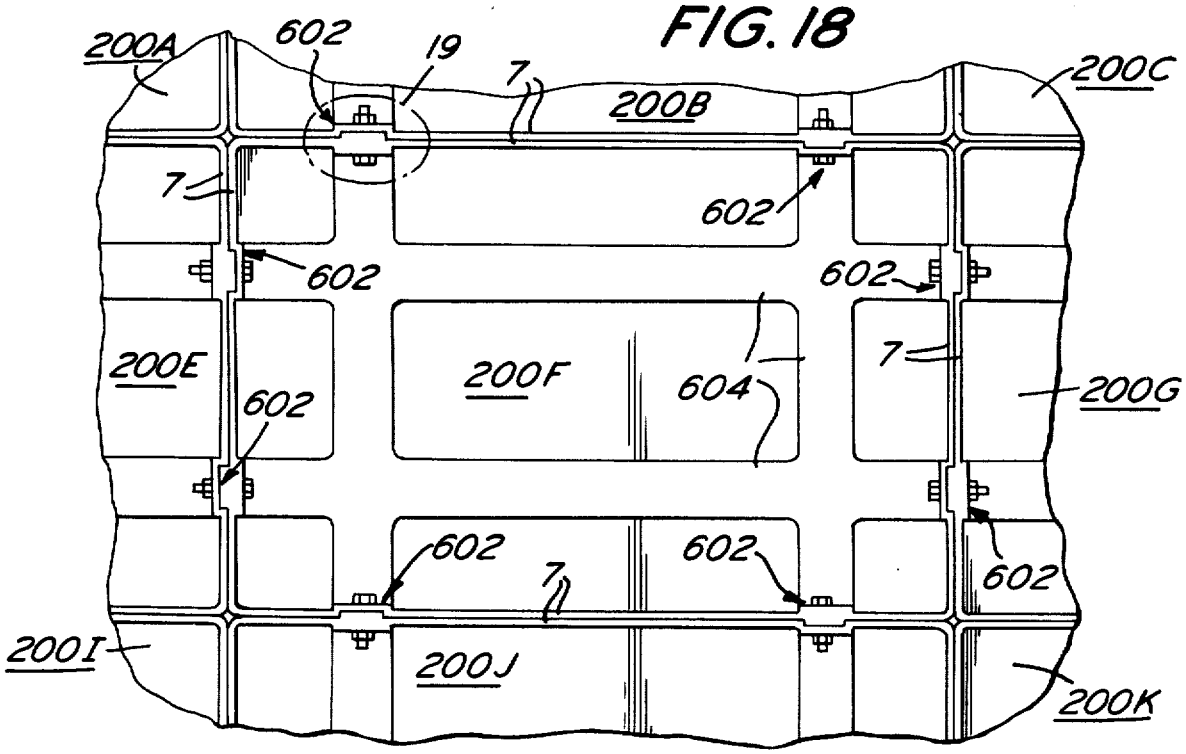
FIG. 18 is an elevational view showing the interconnection of several panels to form a wall portion of the building shown in FIG. 1.
Figure 19:
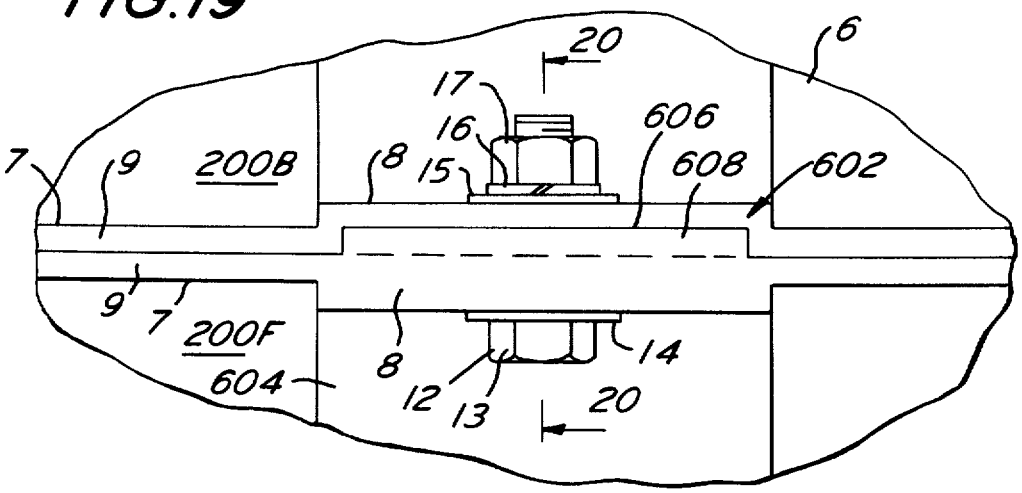
FIG. 19 is an enlarged view of the portion shown within area 19 of FIG. 18.
Figure 20:
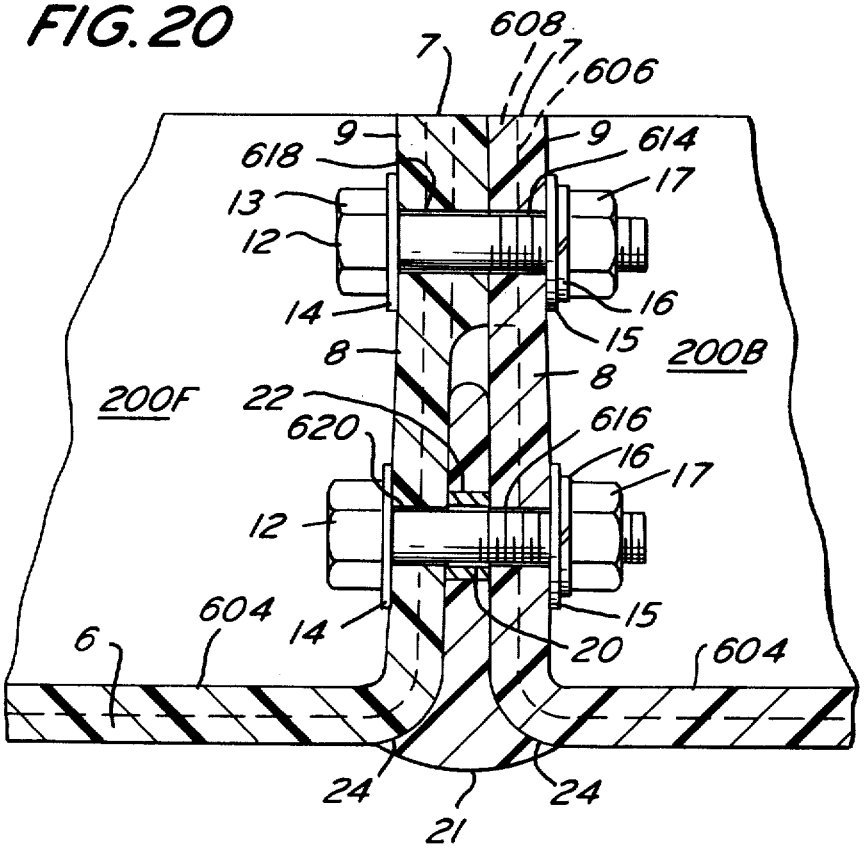
FIG. 20 is a sectional view taken along line 20—20 of FIG. 19.

The operation of the interlocking means 602 can best be appreciated by reference to FIGS. 18, 19 and 20.

In FIG. 18 there is shown a portion of wall 200 formed of panels 600 in accordance with the preferred aspect of this invention.

As can be seen therein the wall portions shown comprises eight panels 200A, 200B, 200C, 200D, 200E, 200F, 200G, 200I, 200J and 200K, with panels 200A, 200B, 200C, 200E, 200G, 200I, 200J and 200K being connected, via respective flanges thereon, to panel 200F. The connection between each of the adjacent panels is the same and therefore only the connection between panels 200B and 200F will be described hereinafter. As can be seen panels 200B and 200F are disposed immediately adjacent each other with their flanges 7 abutting such that tab 608 of panel 200F is disposed within mating recess 606 in the flange 7 of panel 200B. Similarly, the tab 608 of the flange of panel 200B is disposed within the mating recess 606 in the flange 7 of the panel 200F.

By viture of the mating interlocking nature of the tab 608 and recess 606 of the interlocking means 602 the panels can be readily aligned with each other by merely inserting the desired tab within the desired recess. Once this is done the panels are aligned and can be readily secured to one another via the same type readily-disconnectable fixed fastening means as described heretofore.

As can be seen in FIG. 17 each mesa 8 includes a pair of holes extending therethrough, with the pair of holes on the mesa contiguous with the recess 606 being denoted by the reference numeral 610 and with the pair of holes on the mesa contiguous with the tab 608 being denoted by the reference numeral 612. As can be seen the pair of holes 610 includes a hole 614 which passes through the mesa portion and the center of recess 606 while the other hole of the pair, denoted by the reference numeral 616, extends through the mesa portion 8 and flange 7 immediately below the recess 606. The pair of holes 612 includes one hole 618 which extends through the mesa portion 8 and the center of the contiguous tab 608. The other hole of the pair 612 is denoted by the reference numeral 620 and extends through mesa portion 8 and the flange portion 7 immediately below tab 608. The spacing between the holes of each pair is the same such that when the panels are interlocked with tab 608 extending within recesses 606 the holes 610 of the flange of one panel are aligned with the holes 612 of the flange of the abutting panel.

As can be seen in FIG. 20 a pair of readily-disconnectable, fixed fastening means is provided to join panel 200F and 200B via their respective interlocked flange portions. Such fastening means is typical of the fastening means used throughout the building to connect the immediately adjacent panels to one another. In accordance with the preferred embodiment of this invention the readily-disconnectable, fixed fastening means 12 is formed of weatherproof material (e.g., brass) and comprises a pair of elongated threaded tie bolts 13, a pair of flat washers 14 and 15, a lock washer 16 and a nut 17.

The readily-disconnectable, fixed fastening means are arranged such that the shaft portion of the upper tie bolt 13 passes axially through the aligned holes 614 and 618, with the head of the bolt adjacent to flange 7 of panel 200F while the shaft portion of the lower tie bolt 13 passes through the axially aligned holes 616 and 620 with the head of the bolt adjacent to flange 7 of panel 200F. A flat washer 14 is disposed between the head of the upper bolt 13 and the mesa 8 of panel 200F and a second flat washer is disposed between the head of the lower bolt 13 and the mesa 8 of that flange. A flat washer 15 is provided about the threaded shaft of the upper tie bolt 13 and is disposed on the mesa 8 of the flange of panel 200B while a similar flat washer 15 is provided at the threaded shaft of the lower tie bolt and is disposed on the mesa of the flange of said panel. A nut 17 is screwed on the threaded portion of the upper tie bolt 13 and a similar threaded nut is screwed on to the threaded portion of the lower tie bolt 13. A lock washer 16 is interposed between the nut 17 and the flat washer 15 on the upper tie bolt and a similar lock washer 16 is interposed between the nut 17 and the flat washer 15 on the lower tie bolt 13. When the upper tie bolt 13 in axially aligned holes 614 and 618 is tightened, the tab 608 is pulled fully within recess 606 so that the outer surface of the tab 608 abuts the bottom of the recess 606. In addition, the tightening of the bolt 13 causes the outer surface of the rib portion 9 of the flanges 7 to abut one another whereas the non-rib portions of the flanges are spaced apart from one another. A gasket strip 18 is provided within the space between the non-rib portions of the adjacent flanges to provide a weatherproof seal between the panels. The gasket strip includes a flat web portion 19 having a plurality of holes 20 therein and rounded head portion 21. A metal ring 22 is provided within each gasket hole. The thickness of the ring is less than the thickness of the web portion for reasons to be considered later.

As can be seen, the web 19 of the gasket 18 is interposed between the flanges of adjacent panels 200F and 200B with a metal ring lined 20 axially aligned with holes 616 and 620 in the flanges of the panels. The head 21 of the gasket strip is rounded to slightly overlap the relatively planar portions of the panels and includes on its underside two fillet portions 24 which mate with the curved portions of the panels between the flange 7 and the generally planar portion 6. As should be appreciated when the tie bolt 13 in the aligned holes 616 and 620 is tightened the web of the gasket strip 18 is slightly compressed between the adjacent flanges, thereby sealing the joint between the panels 200F and 200B. The thickness of the ring 22 is slightly smaller than the thickness of the web so as not to impede the compression of the web portion of the gasket 18.

Gasket strips are provided between all of the immediately adjacent panels of each wall of the housing to insure that the housing is completely weatherproof.

It should now be appreciated that in accordance with this invention various types of styles of modular buildings can be readily and inexpensively manufactured, handled and assembly since the modular panels forming the walls thereof are relatively small and light and the tie bolt fastening means enables said panels to be rapidly and securely connected to one another. Furthermore, the repair of any wall panel can be accomplished quickly by merely disconnecting the tie bolts joining the damaged panel to immediately adjacent panels and by replacing the damaged panel with an intact panel and reconnecting the tie bolts.

Without further elaboration, the foregoing will so fully illustrate my invention, that others may, by supplying current or future knowledge, adopt the same for use under various conditions of service.

What is claimed as the invention is:

1. A prefabricated modular building including a first external wall portion and a first external roof portion, each portion comprising at least two molded, lightweight structural panels, each panel including a generally planar portion having a plurality of sides and a flange extending along the full length of each side and continuously about the entire periphery of said planar portion, said flange projection generally normally from said flange, with the peripheral edge of said flange being of increased thickness, said panels being connected to each other, with the peripheral edge of a portion of the flange of one panel abutting the peripheral edge of a portion of the flange of another panel and with gasket means disposed within the space between the flange portions contiguous with the abutting edges, the portion of each flange lying along each side of the panel including interlock means comprising a recess in the outside surface of the increased thickness peripheral portion of said flange portion and having an opening therein and a tab extending from said outside surface and spaced from said recess and having an opening therein, such that when said panels are connected together the tab of one portion of one flange is disposed within the recess in one portion of the abutting flange with said openings aligned, said panels being secured to one another by at least one bolt extending through the aligned openings in said abutting flange portions at said interlock mean and perpendicular to said flange portions.

2. The building of claim 1 wherein the tab is configured to be received in a mating relationship within said recess.

3. The building specified in claim 2 wherein said panels are molded of plastic.

4. The building as specified in claim 3 wherein each of said panels includes stiffening ribs extending across the planar portion of said panels and between a portion of the interlock means on a portion of the flange extending along one side of said panel and a portion of the interlock means on a portion of the flange extending along an opposed side of the panel.

5. The building as specified in claim 1 wherein said flange portion includes a pair of enlarged thickness mesa's of coextensive width as said flange on one side thereof and an enlarged thickness rib of lesser width than said flange extending along the other side thereof, with said recess being within said rib contiguous with one mesa and with said tab extending from the rib contiguous with the other mesa.

* * * * *